US010044115B2

(12) United States Patent
Tran et al.

(10) Patent No.: US 10,044,115 B2
(45) Date of Patent: Aug. 7, 2018

(54) UNIVERSAL LINEAR EDGE CONNECTOR

(71) Applicant: Intel Corporation, Santa Clara, CA (US)

(72) Inventors: Donald T. Tran, Phoenix, AZ (US); Gregorio Murtagian, Phoenix, AZ (US); Kuang Liu, Queen Creek, AZ (US); Srikant Nekkanty, Chandler, AZ (US); Feroz Mohammad, Chandler, AZ (US); Karumbu Meyyappan, Portland, OR (US); Hong Xie, Phoenix, AZ (US); Russell S. Aoki, Tacoma, WA (US); Gaurav Chawla, San Jose, CA (US)

(73) Assignee: Intel Corporation, Santa Clara, CA (US)

( * ) Notice: Subject to any disclaimer, the term of this patent is extended or adjusted under 35 U.S.C. 154(b) by 32 days.

(21) Appl. No.: 14/757,626

(22) Filed: Dec. 23, 2015

(65) Prior Publication Data

US 2017/0187147 A1 Jun. 29, 2017

(51) Int. Cl.
*H01R 4/50* (2006.01)
*H01R 13/639* (2006.01)
(Continued)

(52) U.S. Cl.
CPC ..... *H01R 4/5066* (2013.01); *H01R 4/5008* (2013.01); *H01R 4/52* (2013.01);
(Continued)

(58) Field of Classification Search
CPC .. H01R 13/508; H01R 4/5066; H01R 4/5008; H01R 4/52
See application file for complete search history.

(56) References Cited

U.S. PATENT DOCUMENTS 4,069,403 A * 1/1978 Beaudette ..... H01H 23/006 200/339
4,253,719 A * 3/1981 McGinley ..... H01R 12/721 439/329

(Continued)

FOREIGN PATENT DOCUMENTS

JP 2013143202 A 7/2013
TW 201725804 7/2017

OTHER PUBLICATIONS

"International Application Serial No. PCT/US2016/063333, International Search Report dated Mar. 10, 2017", 3 pgs.

(Continued)

*Primary Examiner* — James Harvey
(74) *Attorney, Agent, or Firm* — Schwegman Lundberg & Woessner, P.A.

(57) ABSTRACT

An apparatus comprises a cable connector including: a first connector body portion including a first plurality of electrical contacts arranged to contact electrical contacts of a first surface of an edge connector substrate; a second connector body portion separate from the first connector body portion and including a second plurality of electrical contacts arranged to oppose the first plurality of electrical contacts of the first connector body portion and to contact electrical contacts of a second surface of the edge connector substrate, wherein the first and second plurality of electrical contacts are electrically coupled to one or more cables; and a joining mechanism configured to join the first connector body portion and the second connector body portion together and to apply a bias force to the edge connector substrate when the edge connector substrate is arranged between the first connector body portion and the second connector body portion.

7 Claims, 11 Drawing Sheets

(51) Int. Cl.

| | |
|---|---|
| ***H01R 4/52*** | (2006.01) |
| ***H01R 13/508*** | (2006.01) |
| ***H01R 12/85*** | (2011.01) |
| *H01R 12/72* | (2011.01) |

(52) U.S. Cl.
CPC ..... *H01R 12/85* (2013.01); *H01R 13/508* (2013.01); *H01R 13/639* (2013.01); *H01R 12/721* (2013.01)

(56) References Cited

U.S. PATENT DOCUMENTS 5,092,781 A * 3/1992 Casciotti ..... H01R 12/856 439/161
5,171,154 A * 12/1992 Casciotti ..... H01R 12/7082 439/260
5,482,474 A * 1/1996 Yohn ..... H05K 3/3405 439/289
6,152,742 A * 11/2000 Cohen ..... H01R 13/502 439/108
6,231,365 B1 5/2001 Konno et al.
6,416,335 B1 * 7/2002 Horchler ..... H01R 12/721 439/79
7,785,140 B2 * 8/2010 Henry ..... H01R 13/514 439/541.5
8,939,790 B2 * 1/2015 Jung ..... H01R 13/62 439/483
9,166,315 B1 * 10/2015 Phillips ..... H01R 12/725
2003/0143873 A1 * 7/2003 Burmeister ..... H01R 12/79 439/74
2006/0172572 A1 8/2006 Matsukawa et al.
2006/0223375 A1 10/2006 Chang et al.
2011/0136387 A1 6/2011 Matsuura et al.
2017/0187134 A1 * 6/2017 Boyd ..... H01R 12/721
2017/0187147 A1 * 6/2017 Tran ..... H01R 12/721

OTHER PUBLICATIONS

"International Application Serial No. PCT/US2016/063333, Written Opinion dated Mar. 10, 2017", 9 pgs.

* cited by examiner

UNIVERSAL LINEAR EDGE CONNECTOR

TECHNICAL FIELD

Embodiments pertain to high speed fabric cable connections for electronic systems. Some embodiments relate to linear edge connectors for fabric cabling.

BACKGROUND

Electronic systems often include packaged electronic assemblies of integrated circuits (ICs) that communicate together. The packaged electronic assemblies can include multi-chip modules (MCMs) and package on package (PoP) modules that include multiple integrated circuit dice. The packaged components can include one or more processors, memory such as dynamic random access memory (DRAM). High performance electronic systems can include many electronic assemblies having processors (e.g., central processor units or CPUs) and memory (e.g., dynamic random access memory or DRAM) mounted on substrates that are interconnected with high-speed fabric interconnections. Fabric interconnection refers to a network topology between electronic devices (e.g., CPUs) to provide point-to-point communication among the devices using multiple physical links. The network topology can include multiple network switches (e.g., crossbar switches) to provide a switching fabric among the electronic devices.

One approach for connecting substrates of electronic assemblies to the cables of the fabric interconnection is to use linear edge connectors (LECs) to contact the substrate or board of the electronic assembly. The thickness of a substrate or board can depend on the number of layers included in the substrate. LECs are then typically sized to accommodate a specific substrate requirement. There are general needs for devices, systems and methods to address requirements for high-speed fabric interconnections.

DETAILED DESCRIPTION

The following description and the drawings sufficiently illustrate specific embodiments to enable those skilled in the art to practice them. Other embodiments may incorporate structural, logical, electrical, process, and other changes. Portions and features of some embodiments may be included in, or substituted for, those of other embodiments. Embodiments set forth in the claims encompass all available equivalents of those claims.

As explained previously herein, LECs are typically sized to for a specific substrate requirement. For example, the spacing between contacts of the LECS accommodates a specific substrate. If a different electronic assemblies include substrates of different thicknesses, the multiple substrate sizes would need multiple fabric connectors with LECs of different sized openings. A better approach would be an LEC design that can accommodate substrates of varying thickness.

Figure 1A:
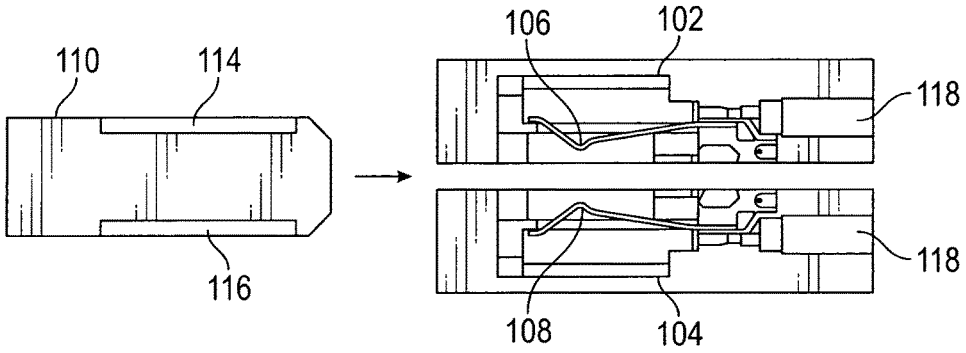
FIGS. 1A and 1B illustrate portions a cable connector for connection to an edge connector substrate in accordance with some embodiments.

FIG. 1A illustrates portions of an embodiment of a cable connector, such as a fabric cable connector, for connection to an edge connector substrate. A side view is shown in the Figure. The connector includes a first connector body portion 102 and a separate second connector body portion 104. The first and second body portions receive an edge connector substrate 110 between them. Only a portion of the edge connector substrate 110 is shown. The substrate may be included in a packaged electronic assembly that includes multiple ICs. The first connector body portion 102 includes electrical contacts 106 arranged to contact electrical contacts 114 of a surface (e.g., the top surface) of the edge connector substrate 110. The second connector body portion 104 includes electrical contacts 108 that oppose the electrical contacts 106 of the first connector body portion and to contact electrical contacts 116 of a second surface (e.g., a bottom surface) of the edge connector substrate 110. The electrical contacts of the body portions of the cable connectors are electrically coupled to one or more cables 118. An electrical contact may be included on a conductive element. The conductive element can be elongate and can include the electrical contact at one end and be electrically coupled to a cable on the other end.

Figure 1B:
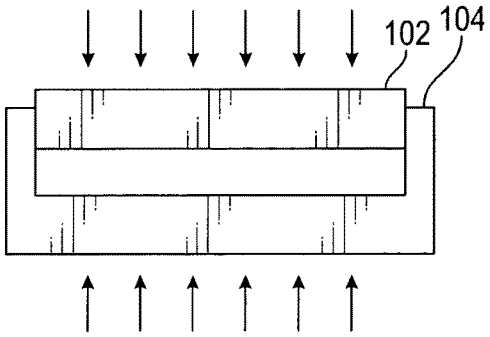

FIG. 1B is a front view of an embodiment of a cable connector. The first connector body portion 102 and the second connector body portion 104 are movable relative to each other. In some embodiments, a joining mechanism is included to join the first connector body portion 102 and the second connector body portion 104 together. The joining mechanism applies a bias force to the edge connector substrate 110 when the edge connector substrate 110 is arranged between the first connector body portion 102 and the second connector body portion 104. Because there are separate connector body portions, the cable connector can be mated with substrates of a wide range of thicknesses. Also, the cable connector holds the substrate tightly when engaged or in a closed position. This may reduce the amount of electrical contact fretting. Fretting refers to contact wear caused by small repetitive motion or vibration in what appears to be a stationary connection. Also, the cable connector reduces the amount of sliding between the contacts which can cause premature wear of gold included in the electrical contacts.

Figure 2A:
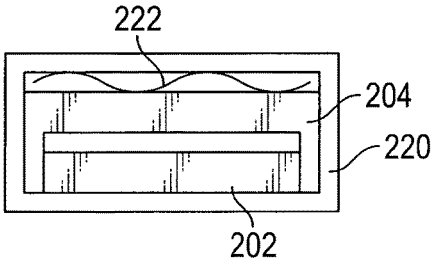
FIGS. 2A-2C are further examples of cable connectors for connection to an edge connector substrate in accordance with some embodiments.

FIG. 2A is a front view of another embodiment of a cable connector for connection to an edge connector substrate. The embodiment includes a first connector body portion 202, a second connector body portion 204, and a joining mechanism. The joining mechanism includes a housing 220 or shell arranged around the connector body portions. The housing 220 includes an opening to receive the edge connector substrate, which is inserted laterally into the opening and positioned between the connector body portions. The joining mechanism also includes one or more springs arranged internal to the housing 220 and against the housing 220. The housing 220 may be rigid and the spring 222 applies a bias force to the second connector body portion 204 to bias the second connector body portion 204 toward the first connector body portion 202 and against the substrate when it is inserted. The spring 222 is shown at the top of the housing 220 in FIG. 2A. In a variation of the embodiment, the spring 222 is placed on the bottom of the housing 220 and applies the bias force against the first connector body portion 202. In another variation, springs are arranged at both the top and the bottom of the housing and applies the bias force against both of the of the connector body portions.

Figure 2B:
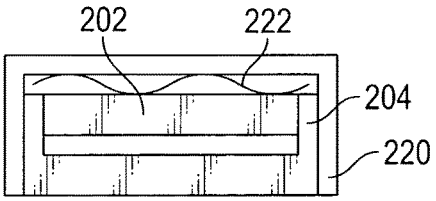
Figure 2C:
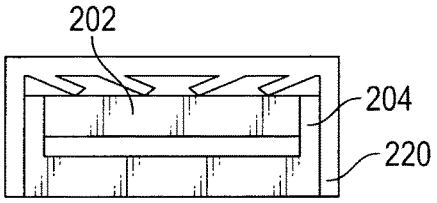

FIG. 2B is a front view of another variation of the embodiment of FIG. 2A. The housing 220 is fixed to the second connector body portion 204. The spring 222 is internal to the housing 220 and applies the bias force against the first connector body portion 202 to bias the first connector body portion 202 toward the second connector body portion 204. FIG. 2C is a front view of another variation of the embodiment of FIG. 2A. The housing 220 is fixed to the second connector body portion 204 as in FIG. 2B, but in the variation of FIG. 2C, the spring is integral to the housing 220. The spring or springs in FIG. 2C include finger-like extensions that apply the bias force against the connector body.

Figure 3:
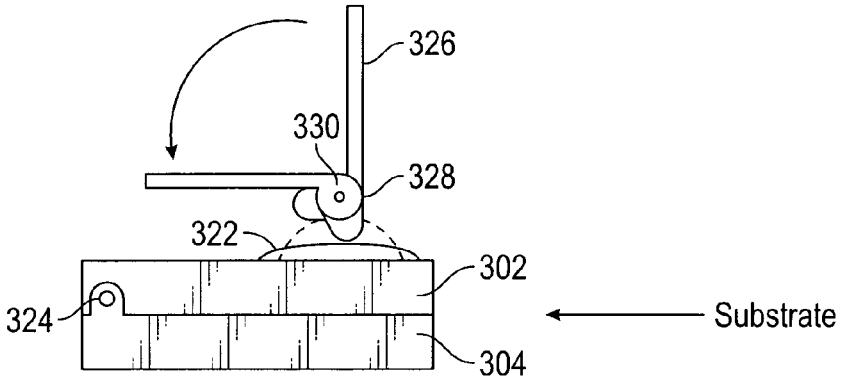
FIG. 3 is a side view of another cable connector for connection to an edge connector substrate in accordance with some embodiments.

FIG. 3 is a side view of another embodiment of a cable connector for connection to an edge connector substrate. The embodiment includes a first connector body portion 302, a second connector body portion 304, and a joining mechanism. The body portions may be connected at one end such as by the pin 324 and socket shown. The joining mechanism includes a lever arm 326 and a cam 328. The lever arm 326 turns about a pivot point 330. The cam 328 is arranged at the pivot point of the lever arm 326 and the cam 328 is rotatable by the lever arm 365. The cam 328 and lever arm 326 may be formed as a single piece or unit. The pivot point 330 may include a pin mounted to a housing (not shown) that holds the pivot point in a fixed position relation to the body connector portions. The housing may be fixed to the second connector body portion 304. The joining mechanism includes a spring 322 arranged or positioned between the cam 328 and the first connector body portion 302. In the open position, the spring 322 is uncompressed and the substrate can be inserted between the connector body portions. When the lever arm 326 is rotated counterclockwise in the Figure to a closed position, the spring 322 is compressed by the cam 328 and the spring 322 applies a bias force to the first connector body portion 302 and applies a bias force to an inserted substrate.

Figure 4A:
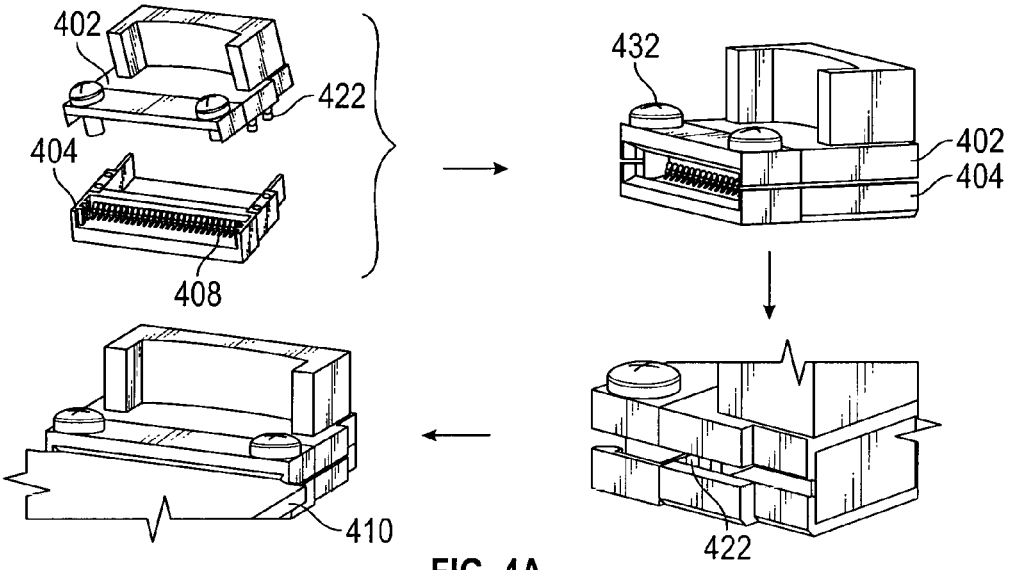
FIGS. 4A-4B are views of another cable connector for connection to an edge connector substrate shown in several views in accordance with some embodiments.

FIG. 4A is another embodiment of a cable connector shown in several views. The embodiment includes separate first and second connector body portions. The electrical contacts 408 of the second connector body portion 404 can be seen in the Figure. The embodiment includes one or more springs 422 arranged between the first connector body portion 402 and the second connector body portion 404 to bias the first and second connector body portions apart. The joining mechanism includes one or more screws 432 and threaded screw holes. In some variations of the embodiment, one of the connector body portions will include alignment posts or pins that fit into alignment holes on the other connector body portion. When the screws are not engaged or tightened, the springs push the connector body portions apart and an edge connector substrate 410 can be inserted between them. This makes substrate insertion easy and may reduce insertion wear of gold on the electrical contacts of the substrate and the connector body portions.

Figure 4B:
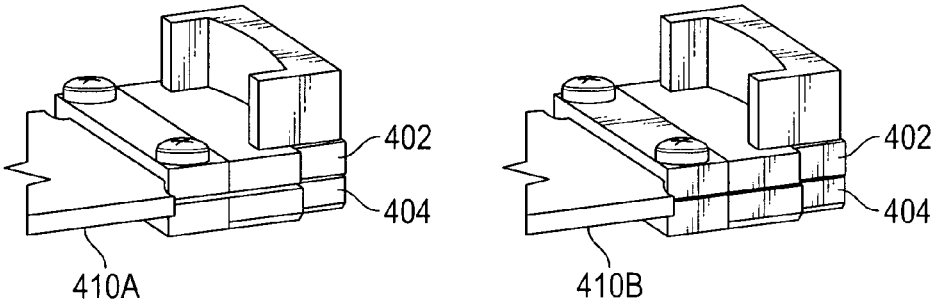

When the screws are tightened, the screws provide force to the electrical contacts of the connector to mate with the electrical contacts of the substrate. The screws provide a clamping force that ensures that the connectors are firmly engaged and reduces or eliminates any micro-motion that may cause contact fretting. FIG. 4B shows examples of a thicker substrate 410A and a thinner substrate 410B inserted into the cable connector and the screws of the connector tightened.

Figure 5:
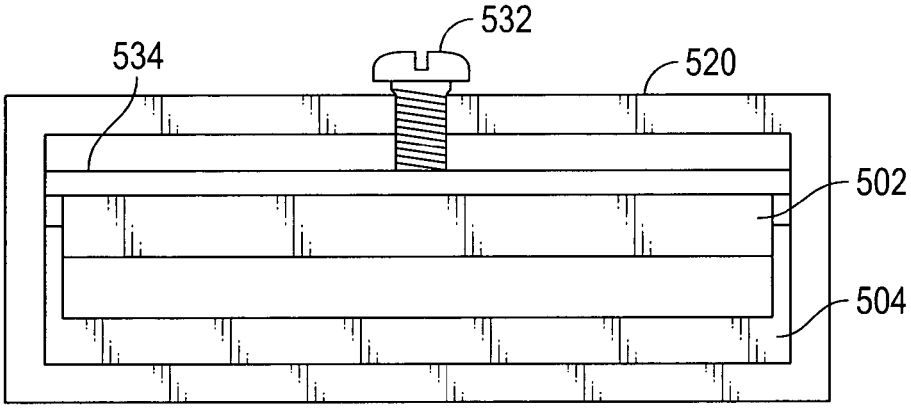
FIG. 5 is a front view of another cable connector for connection to an edge connector substrate in accordance with some embodiments.

FIG. 5 is a front view of another embodiment of a cable connector for connection to an edge connector substrate. As in FIG. 4A, the embodiment includes one or more springs arranged between the first connector body portion 502 and the second connector body portion 504, and the springs bias the connector body portions apart. The joining mechanism includes a housing 520 arranged around the first and second connector body portions and the housing 520 includes an opening to receive the edge connector substrate between the connector body portions. The joining mechanism also includes a tie bar 534 arranged within the housing and adjacent the first connector body portion 502. A surface of the housing includes a threaded screw hole to receive a screw 532 to push the tie bar 534 against the first connector body portion 502 and apply the bias force to the edge connector substrate and bias the first connector body portion 502 toward the second connector body portion 504. The embodiment of the cable connector in FIG. 5 operates similarly to the embodiments of FIGS. 4A-4B except that the tie bar distributes the bias force over the top connector body portion which eliminates the need for multiple screws. The second connector body portion 504 may be fixed to the housing 520 or integral to the housing 520.

Figure 6:
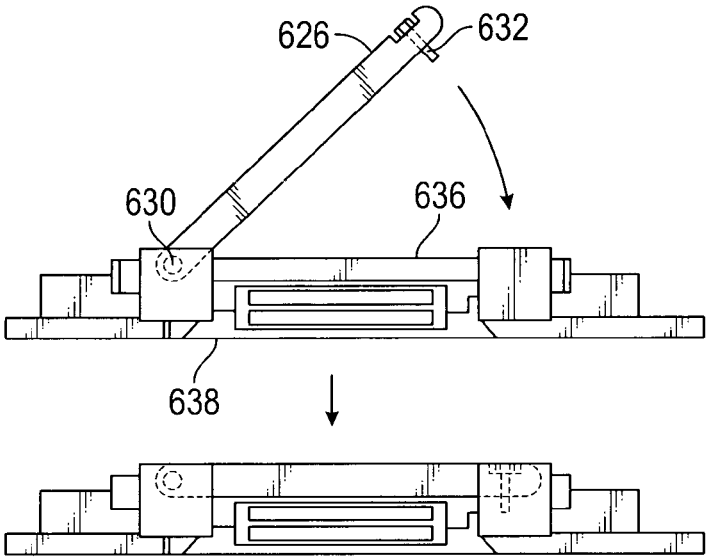
FIG. 6 is a front view of another cable connector for connection to an edge connector substrate in accordance with some embodiments.

FIG. 6 is a front view of another embodiment of a cable connector for connection to an edge connector substrate. The embodiment includes separate first and second connector body portions and one or more springs arranged between the first connector body portion and the second connector body portion. The one or more springs bias the first and second connector body portions apart. The substrate is inserted between the connector body portions to engage the electrical contacts of the connector body portions. The joining mechanism includes a housing having a first movable housing portion 636 that contacts the first connector body portion and a second housing portion 638 to contact the second connector body portion.

The embodiment also includes a lever arm 626 that has a pivot point 630 connected to the second housing portion 638. To close the joining mechanism, the lever arm 626 turns about the pivot point 630 to contact the first movable housing portion 636 and apply bias force to the first movable housing portion and to the first connector body portion. The bias force presses the connector body portions together and the electrical contacts of the connector body tightly engage the electrical contacts of the inserted edge connector substrate. The lever arm 626 may include teeth to more firmly push against the top of the housing. The joining mechanism may include a locking mechanism to hold the lever arm in the closed position. In the embodiment shown in FIG. 6, the locking mechanism includes a screw 632 and a threaded screw hole. The joining mechanism may be an added-on assembly that is separate from the connector body portions of the cable connector.

Figure 7A:
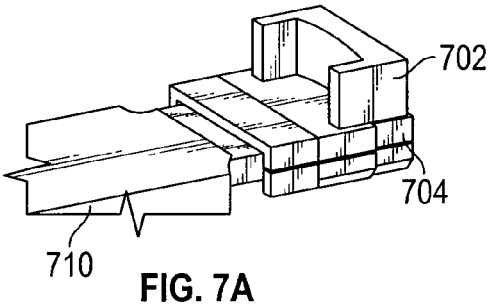
FIGS. 7A-7D are views of further examples cable connectors for connection to an edge connector substrate in accordance with some embodiments.
Figure 7B:
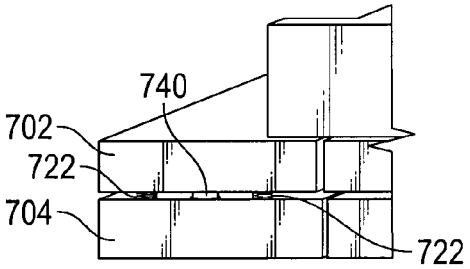
Figure 7C:
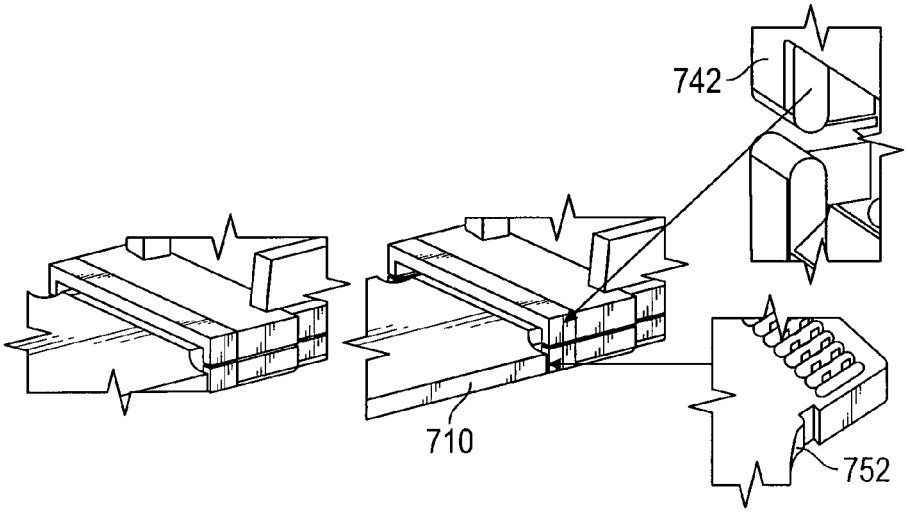

FIGS. 7A-7C are views of further embodiments of a cable connector for connection to an edge connector substrate. As shown in FIG. 7A, the embodiment includes a first connector body portion 702 and a second connector body portion 704. In this embodiment, the joining mechanism draws the connector body portions together when the edge connector substrate 710 is not inserted. The connector body portions separate for insertion of the edge connector substrate 710. As shown in FIG. 7B, the joining mechanism may include tension springs 722 to draw the connector body portions together to provide a bias force to the substrate. The first connector body portion 702 may include multiple pegs 740 and the second connector body portion may include multiple slots to receive the pegs for aligning the connector body portions.

FIG. 7C illustrates insertion of the substrate into the connector body. The connector body portions may include features that ride on the substrate as the substrate is inserted to add separation between the electrical contacts of the substrate and the electrical contacts of the connector body portions. The separation prevents wear on the electrical resulting from sliding between the contacts. In some embodiments, one or both of the first and second connector body portions include tabs 742 that ride on the edge connector substrate 710. When the substrate reaches the desired position between the first and second body portions, the tabs 742 engage matching notches 752 in the edge connector substrate. Because the tabs no longer ride on the substrate when the tabs reach the position of the notches, the tension springs then pull the first and second body portions together.

Figure 7D:
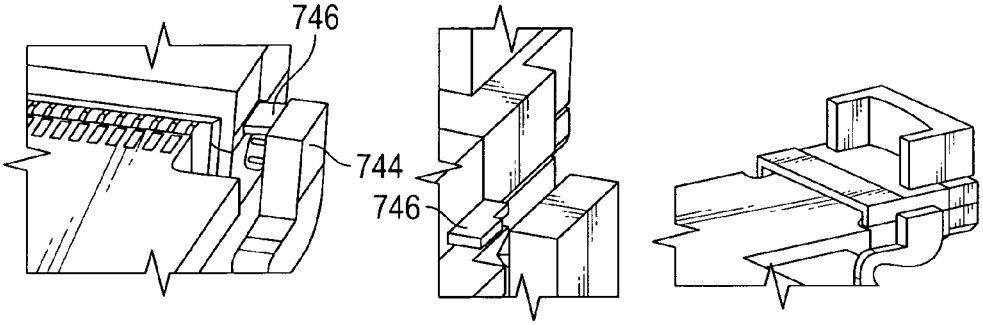

FIG. 7D is a variation of the embodiment in FIGS. 7A-7C. The first and second connector body portions are slidable relative to a bolster 744. The bolster may be included in the cable connector or included separately. When disengaged from the substrate and bolster, the first and second body portions are drawn together by the tension springs 722. The first and second connector body portions include wings 746 that extend away from the connector body portions. To insert the substrate, the connector body is toward slid toward the bolster 744 and the edge connector substrate 710. When the wings 746 engage the bolster 744 in a first position, a plate of the bolster 744 separates the wings 746 which separates the first and second body portions. As the sliding of the connector body continues, the connector body eventually reaches a second position in which the connector is in the desired portion relative to the substrate and the wings of the first and second body portions are past the plate of the bolster 744. In the second position, the first and second body portions are allowed to be drawn together. The plate of the bolster has a thickness to ensure enough separation between the first and second connector body portions to accommodate the full range of thicknesses of the edge connector substrates. The bolster may be useful to align the connector body with the substrate. One or both of the bolster and the connector body portions may include hard stop features to control the extent of travel between the between the substrate and the connector body.

Figure 8:
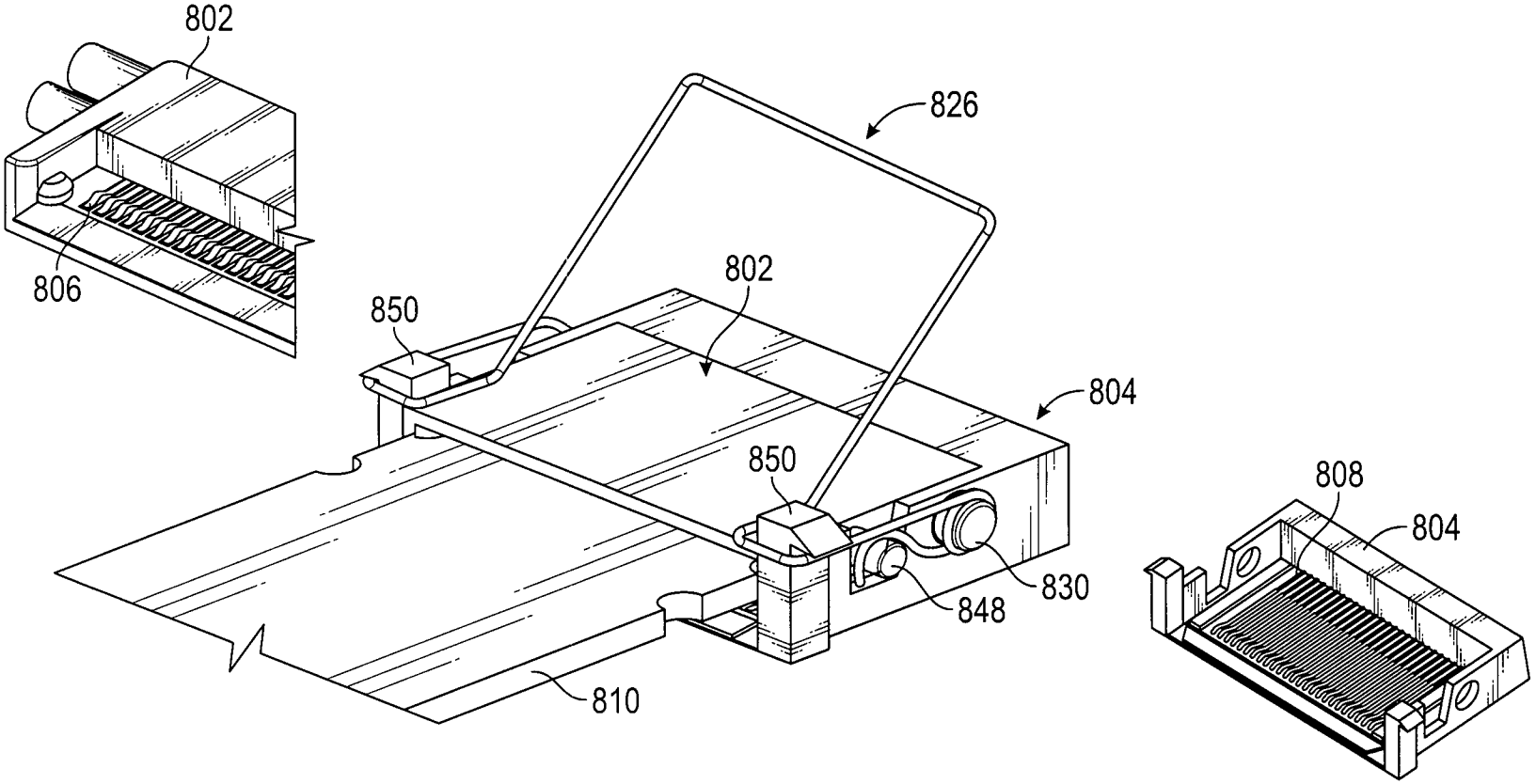
FIG. 8 is another cable connector for connection to an edge connector substrate in accordance with some embodiments.

FIG. 8 is another embodiment of a cable connector for connection to an edge connector substrate. The cable connector body includes a first connector body portion 802 and a second connector body portion 804. The Figure shows the cable connector in the closed position with the edge connector substrate 810 inserted. FIG. 8 also shows the electrical contacts 806 of the first connector body portion 802 and the electrical contacts 808 of the second connector body portion 804.

The cable connector includes a lever 826 that contacts the first connector body portion at opposite edges of the first connector body portion. In some embodiments, the lever 826 is bale-shaped and comprises wire. The second connector body portion 804 includes sidewalls. The sidewalls each include a lever pivot point 830. The first connector body portion 802 includes a peg 848 to provide a load point for the lever 826. When the lever 826 is in a closed position, the lever 826 applies a bias force to the first connector body portion 802 and the substrate. When the lever 826 is in the open position, the first connector body portion 802 is relieved of the bias force.

In some embodiments, the sidewalls each include a locking mechanism 850 for the lever 826. The lever 826 is rotatable about each lever pivot point 830 to engage each locking mechanism 850. The lever 826 applies the bias force to the first connector body portion 802 when the lever 826 engages the locking mechanism 850. In certain embodiments, the locking mechanism 850 includes tabs that extend away from the sidewalls second connector body portion 804. The lever 826 is latched over the tabs when locked to maintain the bias force to the first connector body portion 802 and the substrate. To disengage the locking mechanism 850, the sides of the lever pushed outward over the tabs.

Figure 9A:
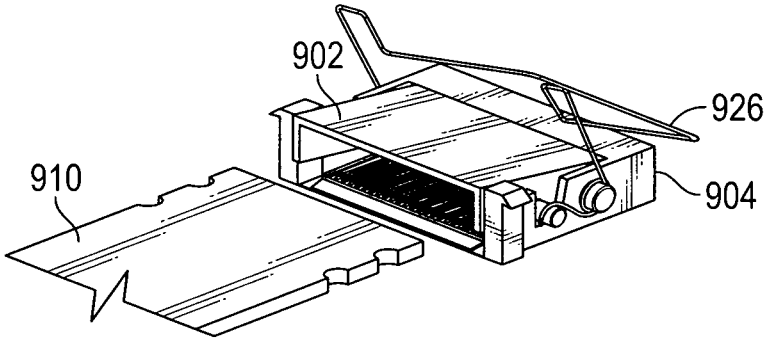
FIGS. 9A-9D and FIG. 10 illustrate attachment of the cable connector of FIG. 8 to an edge connector substrate in accordance with some embodiments.
Figure 9B:
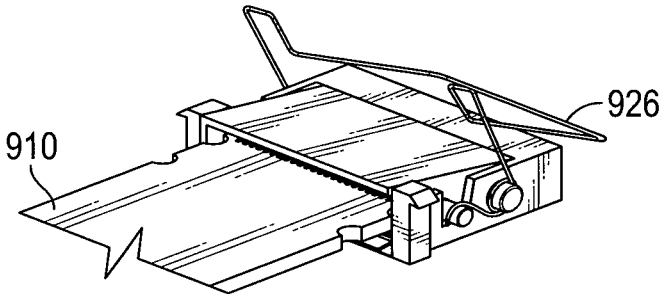
Figure 9C:
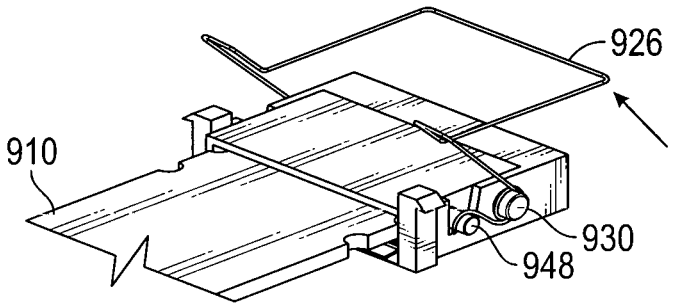
Figure 9D:
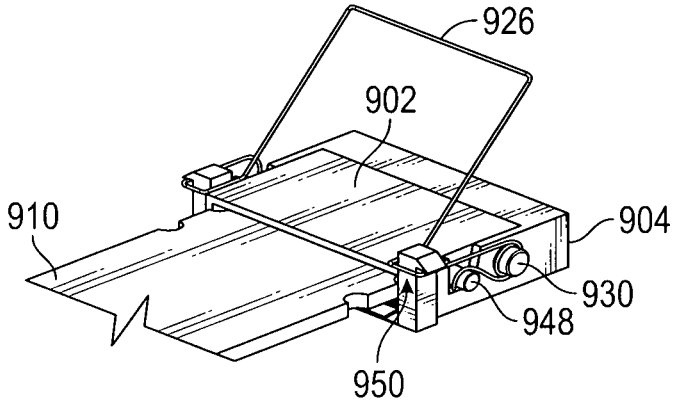
Figure 10:
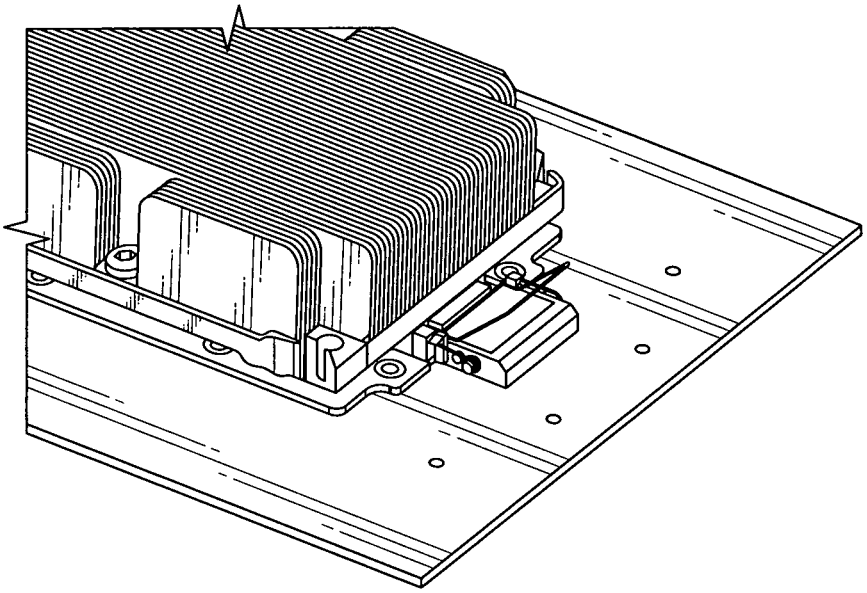

FIGS. 9A-9D illustrate attachment of the cable connector of FIG. 8 to an edge connector substrate. In FIG. 9A, the lever 926 of the cable connector is in the open position. In FIG. 9B, the edge connector substrate 910 is inserted into the two part connector body. The connector body is open and edge connector substrate 910 can be inserted with zero insertion force. The connectors of the edge connector substrate 910 receive minimal wipe during the insertion. In FIG. 9C, pulling up on the lever 926 rotates the bale-shaped about the pivot point 930 and creates torsion on the pegs 948 of the first body connector portion. In FIG. 9D, the lever 926 is latched onto the locking mechanism 950 of the second body connector portion 904 to maintain a normal bias force on the contacts of the edge connector substrate and the connector body. FIG. 10 illustrates the cable connector attached to the substrate. The cable or cables of the cable connector are not illustrated in FIG. 10. The cable connector does not require attachment to any external fixture of the substrate or electronic assembly (e.g., a heat sink) to retain connection.

Figure 11A:
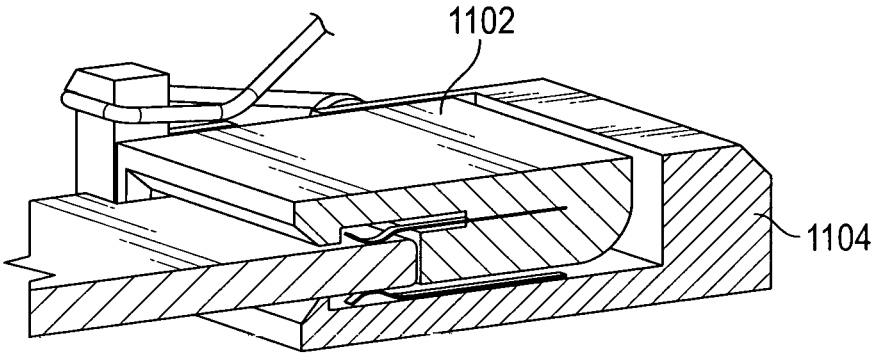
FIGS. 11A-11B show cutaway views from the side of the cable connector of the embodiment of FIG. 8 in accordance with some embodiments.
Figure 11B:
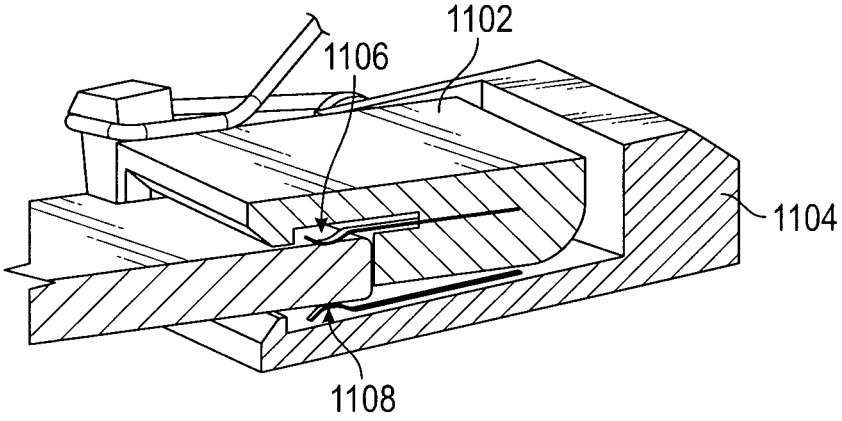

FIGS. 11A-11B show cutaway views from the side of the cable connector of the embodiment of FIG. 8. In some embodiments the back end of the first connector body portion 1102 is rounded. The first connector body portion 1102 may pivot relative to the second connector body portion 1104 to accommodate substrates of different thicknesses. FIG. 11A shows a thinner edge connector substrate inserted into the connector body and FIG. 11B shows a thicker edge connector substrate inserted into the connector body. The Figures show that the working range of the electrical contacts 1106, 1108 of the connector body is not affected by the change in edge connector substrate thickness.

Figure 12A:
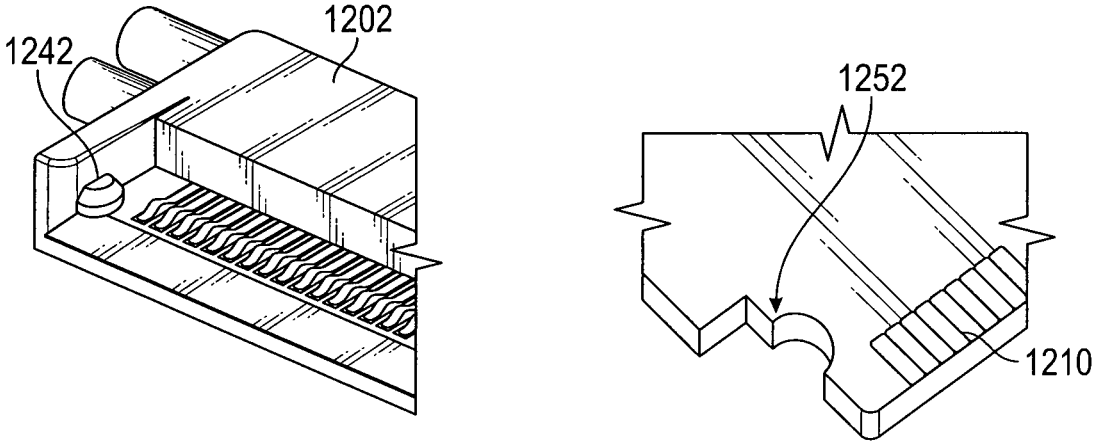
FIGS. 12A-12C show a variation of the embodiment of the cable connector of FIG. 8 in accordance with some embodiments.
Figure 12B:
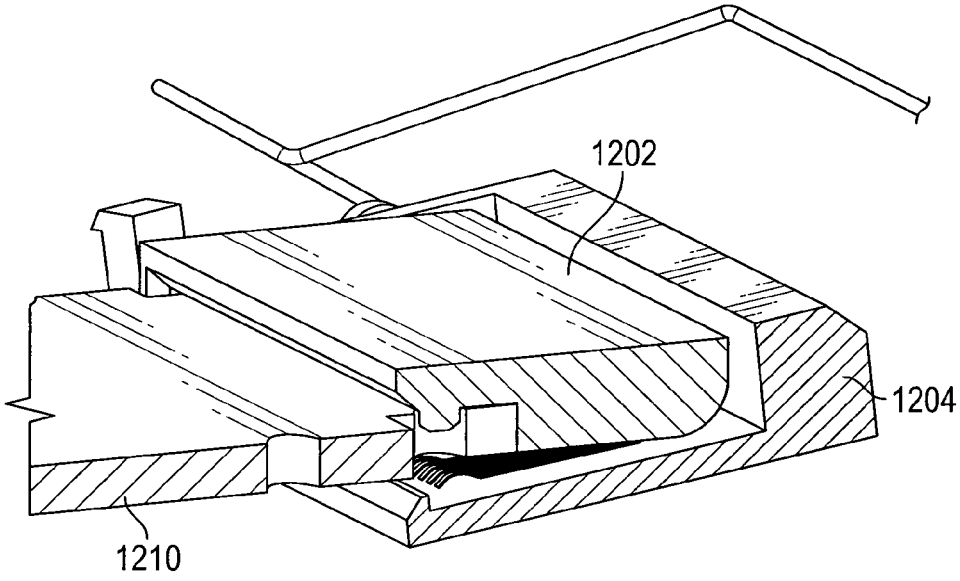
Figure 12C:
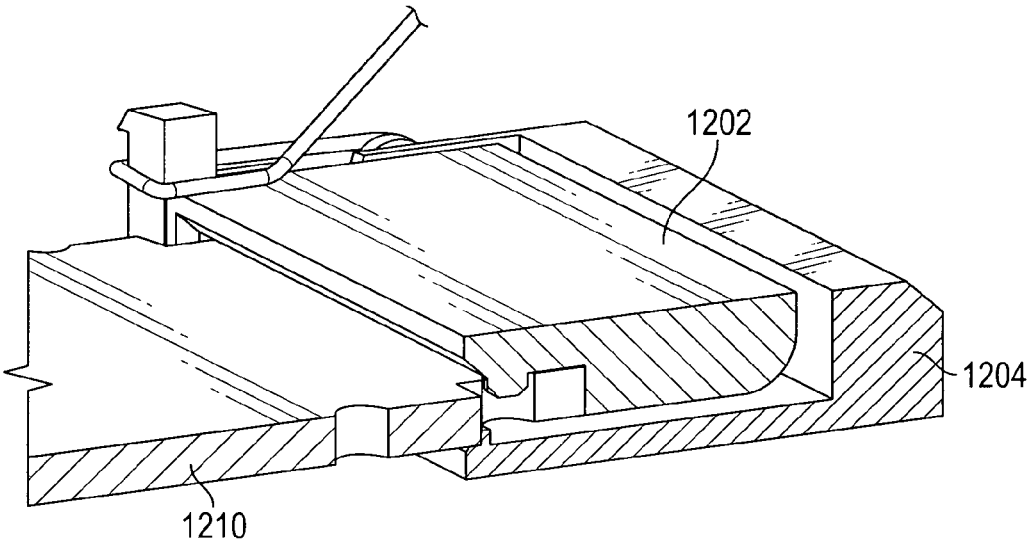

FIGS. 12A-12C show a variation of the embodiment of the cable connector of FIG. 8. FIG. 12A is cutaway view of a first connector body portion 1202 that includes a tab 1242 or key, and shows an edge connector substrate 1210 that includes a notch 1252 that receives the tab 1242. Each side of the first connector body portion 1202 may include a tab and each side of the substrate may include a notch to provide connector retention when the substrate is inserted and the connector closed. In variations of the embodiment, the second connector body portion 1204 includes the tabs 1242. FIGS. 12B and 12C show the substrate inserted into the connector body before and after the notches receive the tabs respectively.

Figure 13B:
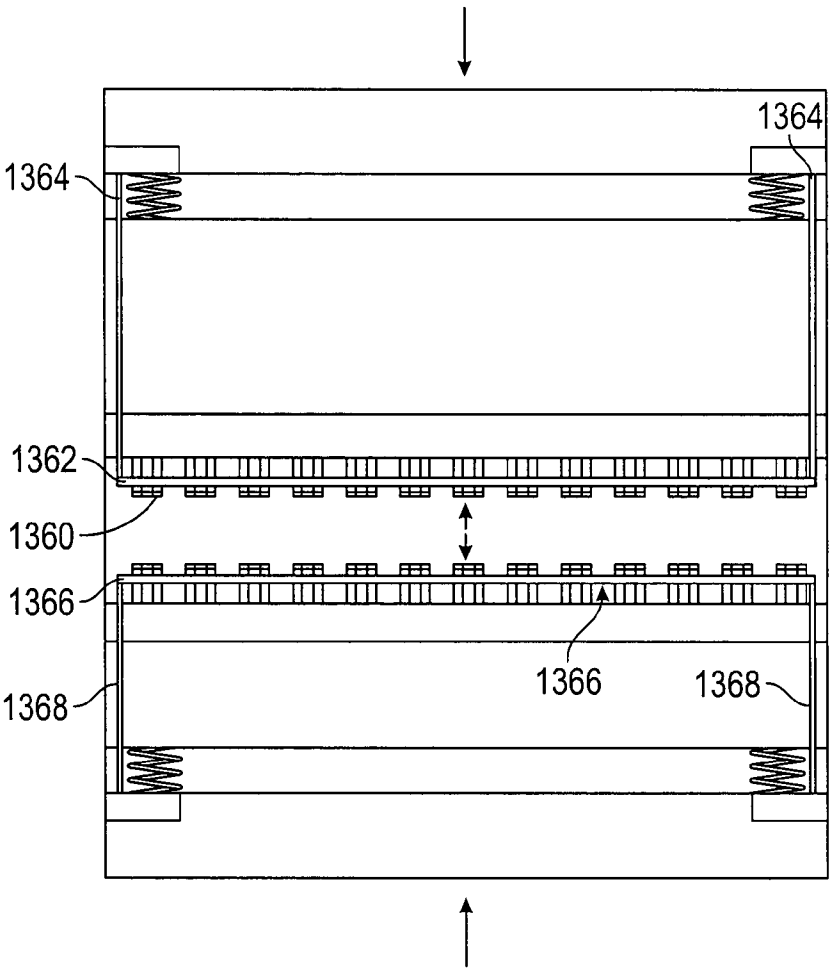
FIGS. 13A and 13B illustrate another cable connector for connection to an edge connector substrate in accordance with some embodiments.
Figure 13A:
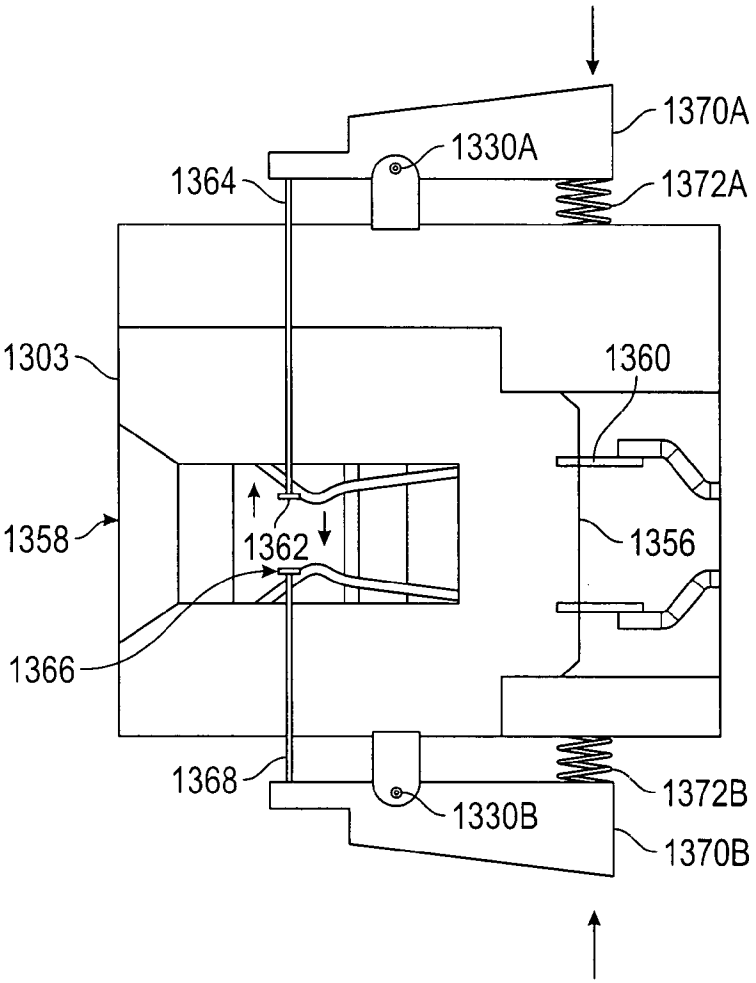

FIGS. 13A and 13B illustrate another embodiment of a cable connector for connection to an edge connector substrate. The embodiment includes a connector body 1303 and conductive elements 1354 in the connector body 1303. FIG. 13A shows a side view of the cable connector. The connector body 1303 is one piece instead of comprising multiple body portions. The cable connector includes a top plate, a bottom plate, and a rear wall 1356 joining the first plate and the second plate to define an inside space of the connector body. The connector body 1303 includes an opening 1358 opposite the rear wall that is sized to receive the edge connector substrate laterally into the opening.

The cable connector includes a set of conductive elements arranged on an inside surface of the top plate and another set of conductive elements arranged on an inside surface of the bottom plate. A conductive element 1360 is elongate and includes a rear wall end to be electrically coupled to a cable, and a contact end that includes an electrical contact 1306. The electrical contact ends of the conductive elements can be retracted toward the top and bottom plates to facilitate insertion of the substrate.

FIG. 13B shows a front view of a cable connector. The cable connector includes a first non-conductive element 1362 joining contact ends of the conductive elements of the top plate, and at least one arm 1364 coupled to the first non-conductive element. The example in FIG. 13B shows two arms connected to the non-conductive element 1362. The one or more arms 1364 are slidable relative to the top plate to move the first non-conductive element and the contact ends of the conductive elements contacting the non-conductive element relative to the inside surface of the top plate. For example, sliding the arm up moves the non-conductive element 1362 up towards the top plate to raise the contact ends toward the top plate.

The cable connector includes a second non-conductive element 1366 joining contact ends of the conductive elements of the bottom plate, and at least one arm 1368 coupled to the first non-conductive element. The one or more arms are slidable in relation to the bottom plate to move the second non-conductive element and the contact ends of the conductive elements relative to the inside surface of the bottom plate.

A conductive element can include a spring element (e.g., by the shape of the bend in the conductive element) to bias the electrical contact end of the conductive element away from the inside surface of the top plate or away from the inside surface of the bottom plate. In FIG. 13A, sliding the arm 1364 up away from the connector body 1303 and sliding the arm 1368 down away from the connector body 1303 retracts the electrical contacts toward the top and bottom plates to widen the opening for insertion of the substrate. Releasing the arms allows the conductive elements to return to the original position.

In some embodiments, the cable connector includes a top lever 1370A arranged on the outside surface of the top plate of the connector body and a bottom lever 1370B arranged on the outside surface of the bottom plate of the connector body. The one or more arms 1364 coupled to the first non-conductive element 1362 include a first rod and a second rod slidable through the top plate and coupled to the top lever 1370A, and the one or more arms 1368 coupled to the second non-conductive element 1366 includes a third rod and a fourth rod slidable through the bottom plate and coupled to the bottom lever 1370B. The first non-conductive element 1362 includes a first beam coupled to the first and second rods and engaging the electrical contact ends of the conductive elements of the top plate, and the second non-conductive element 1366 includes a second beam coupled to the third and fourth rods and engaging the electrical contact ends of the conductive elements of the bottom plate.

In some embodiments, the top lever 1370A includes a first lever end a second lever end. The first lever end is coupled to the one or more arms 1364 that are coupled to the first non-conductive element 1362 and the second lever end is coupled to the outer surface of the top plate by a one or more springs 1372A. A top pivot 1330A is arranged between the first lever end and the second lever end. The bottom lever 1370B also includes a first lever end and a second lever end. The first lever end is coupled to the one or more arms 1368 that are coupled to the second non-conductive elements 1366 and the second lever end is coupled to the outer surface of the bottom plate by a one or more springs 1372B. A bottom pivot 1330B is arranged between the first lever end and the second lever end.

Pushing the second lever ends of the top and bottom levers toward the top and bottom plates causes the first lever ends to raise and pull the contact ends of the conducive elements toward the inside surfaces of the first and second plates, and releasing the second lever ends causes the conductive elements to move away from the inside surfaces of the top plate and bottom plate. In this way, the substrate can be inserted when the second levers ends are pushed or squeezed towards the plates, and releasing the levers allows the electrical contacts of the connector body to engage the contacts of the inserted substrate.

The several devices described provide cable connection between an electronic fabric cable connection and an electronic assembly that includes an edge connector substrate. The cable connectors work with different substrate thicknesses so that one cable connector can be used with multiple substrate designs. The several embodiments of the cable connector provide a low insertion force or no insertion force connection to the substrate. Several of the embodiments reduce the risk of contamination to the electrical contacts of the connection because minimal wipe or no wipe is involved in connecting to the contacts of the substrate. The embodiments do not rely on any external structure of the edge connector substrate to retain the connection, thereby reducing fretting of the contacts.

Figure 14:
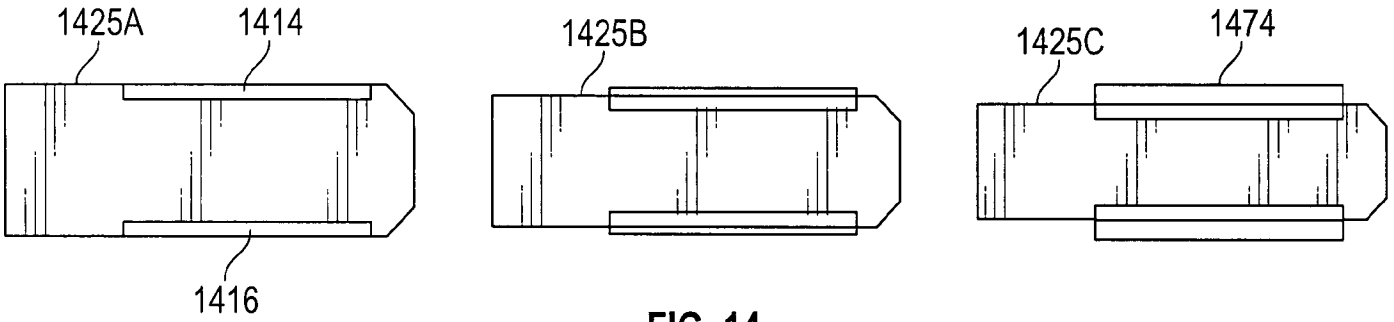
FIG. 14 shows embodiments of portions of edge connector substrates in accordance with some embodiments.

Instead of using a universal linear edge connector for multiple substrate thicknesses, a different approach is to change the thickness of the edge connector substrate to accommodate a specified linear edge connector opening or height between contacts. FIG. 14 shows embodiments of portions of three edge connector substrates 1425A, 1425B, and 1425C. The substrates each include electrical contact pads arranged on a top surface and a bottom surface of the linear edge connector substrates.

A cable connector for electronic fabric interconnection may be configured by shape and size for use with the edge connector substrate 1425A with the greatest thickness. The thickness of the substrate may be related to the number of layers in the substrate. To use edge connector substrates that have less layers than the substrate of 1425A and consequently may be thinner than 1425A (such as substrates 1425B and 1425C), conductive material 1474 can be added to the contact pads to increase the overall thickness of the substrate and contact pads to match the thickness of 1425A. For example, the thickness of substrate 1425A may correspond to a substrate with a first specified substrate layer count, and substrate 1425C may have a different specified layer count resulting in a thinner substrate. Copper or another conductive material can be added to the contact pads of substrate 1425C until the combined thickness of the linear edge connector substrate and the contact pads is the thickness of substrate 1425A and the thickness specified for the cable connector.

Figure 15:
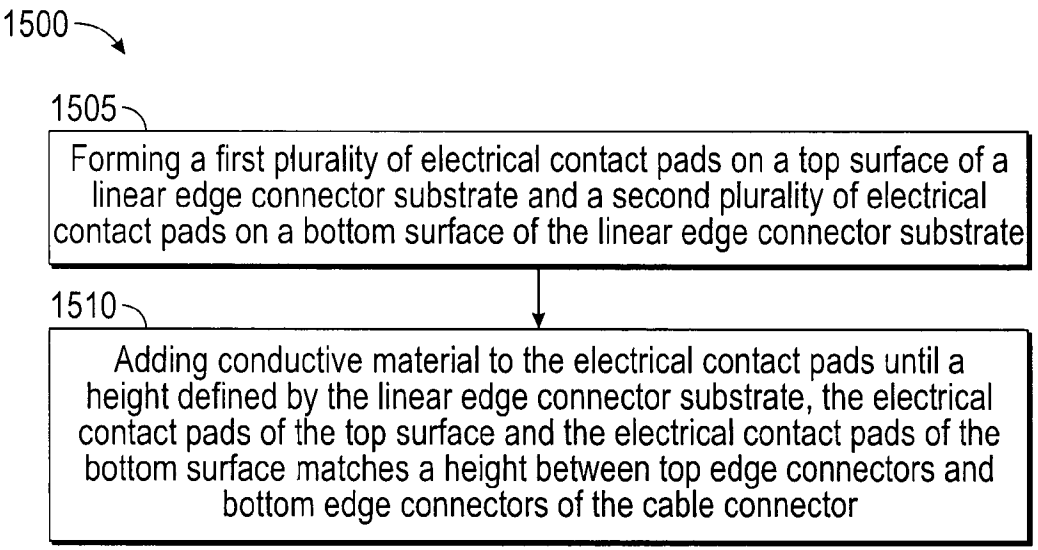
FIG. 15 is a flow diagram of an embodiment of a method of forming an edge connector substrate for electronic fabric interconnection in accordance with some embodiments.

FIG. 15 is a flow diagram of an embodiment of a method 1500 of forming an edge connector substrate for a specified cable connector for electronic fabric interconnection. At 1505, a first plurality of electrical contact pads are formed on a top surface of a linear edge connector substrate and a second plurality of electrical contact pads are formed on a bottom surface of the linear edge connector substrate. The linear edge connector substrate is for insertion into a cable connector configured for electronic fabric interconnection.

At 1510, conductive material is added to the electrical contact pads until a height defined by the linear edge connector substrate, the electrical contact pads of the top surface and the electrical contact pads of the bottom surface matches a height between top edge connectors and bottom edge connectors of the cable connector, or is within the height range specified for use with the cable connector. In some embodiments, copper is deposited on the contact pads to increase the overall height or thickness of the combined substrate and electrical pads.

Additional Description and Examples

Example 1 includes subject (such as an apparatus) comprising a first connector body portion including a first plurality of electrical contacts arranged to contact electrical contacts of a first surface of an edge connector substrate; a second connector body portion separate from the first connector body portion and including a second plurality of electrical contacts arranged to oppose the first plurality of electrical contacts of the first connector body portion and to contact electrical contacts of a second surface of the edge connector substrate, wherein the first plurality of electrical contacts and the second plurality of electrical contacts are electrically coupled to one or more cables; and a joining mechanism configured to join the first connector body portion and the second connector body portion together and to apply a bias force to the edge connector substrate when the edge connector substrate is arranged between the first connector body portion and the second connector body portion.

In Example 2, the subject matter of Example 1 optionally includes a joining mechanism including: a housing arranged around the first connector body portion and the second connector body portion, wherein the housing includes an opening to receive the edge connector substrate; and one or more springs arranged internal to the housing to apply the bias force to one or both of the first connector body portion and the second connector body portion.

In Example 3, the subject matter of one or both of Examples 1 and 2 optionally includes a joining mechanism including a lever arm including a pivot point, wherein the lever arm turns about the pivot point; a cam arranged at the pivot point of the lever arm and rotatable by the lever arm; and a spring arranged between the cam and the first connector body portion, wherein the lever arm in a closed position compresses the spring with the cam to apply the bias force to the first connector body portion.

In Example 4, the subject matter of one or any combination of Examples 1-3 optionally includes one or more springs arranged between the first connector body portion and the second connector body portion to bias the first and second connector body portions apart, and optionally includes a joining mechanism including one or more screws and threaded screw holes.

In Example 5, the subject matter of one or any combination of Examples 1-4 optionally includes one or more springs arranged between the first connector body portion and the second connector body portion to bias the first and second connector body portions apart, and optionally includes a joining mechanism including a housing arranged around the first connector body portion and the second connector body portion, wherein the housing includes an opening to receive the edge connector substrate; and a tie bar arranged within the housing and adjacent the first connector body portion, wherein a surface of the housing includes a threaded screw hole to receive a screw to push the tie bar against the first connector body portion and apply the bias force to the edge connector substrate and bias the first connector body portion toward the second connector body portion.

In Example 6, the subject matter of one or any combination of Examples 1-5 optionally includes one or more springs arranged between the first connector body portion and the second connector body portion to bias the first and second connector body portions apart, and optionally includes a joining mechanism including a housing, including a first movable housing portion to contact the first connector body portion and a second housing portion to contact the second connector body portion; a lever arm including a pivot point connected to the second housing portion, wherein the lever arm turns about the pivot point to contact the first movable housing portion in a closed position and apply the bias force to the first movable housing portion and to the first connector body portion; and a locking mechanism to hold the lever arm in the closed position.

In Example 7, the subject matter of one or any combination of Examples 1-6 optionally includes a first connector body portion including multiple pegs and the second connector body portion includes multiple slots to receive the multiple pegs, wherein the joining mechanism includes one or more springs arranged between the first connector body portion and the second connector body portion, and wherein the one or more springs are configured to draw the first connector body portion and the second connector body portion together to provide the bias force.

In Example 8, the subject matter of Example 7 optionally includes a bolster, wherein the first and second connector body portions include wings extending outward from each side of the first and second connector body portions, and wherein the first and second connector body portions are slidable relative to the bolster from a first position that separates the wings to separate the first and second body portions to a second position that allows the first and second body portions to draw together.

In Example 9, the subject matter of one or both of Examples 7 and 8 optionally includes at least one of the first connector body portion and the second connector body portion including multiple tabs to engage matching notches of the edge connector substrate when the edge connector substrate is inserted between the first connector body portion and the second connector body portion.

In Example 10, the subject matter of one or any combination of Examples 7-9 optionally includes a lever configured to contact the first connector body portion at opposite edges of the first connector body portion, wherein the second connector body portion optionally includes sidewalls, wherein the sidewalls each include a lever pivot point and a locking mechanism, wherein the lever is rotatable about each pivot point to engage each locking mechanism, and wherein the lever applies the bias force to the first connector body when the lever engages the locking mechanism.

In Example 11, the subject matter of one or any combination of Examples 1-10 optionally includes a lever that comprises wire and is bale-shaped.

Example 12 can include subject matter (such as an apparatus), or can be combined one or any combination of Examples of 1-11 to include subject matter, comprising a cable connector for connection to an edge connector substrate, wherein the cable connector optionally includes a connector body including a top plate, a bottom plate, a rear wall joining the first plate and the second plate to define an inside space of the connector body, and an opening opposite the rear wall sized to receive the edge connector substrate; a first non-conductive element joining contact ends of the first plurality of conductive elements of the top plate, and at least one arm coupled to the first non-conductive element and slidable relative to the top plate to move the first non-conductive element and the contact ends of the first plurality of conductive elements relative to the inside surface of the top plate; and a second non-conductive element joining contact ends of the second plurality of conductive elements of the bottom plate, and at least one arm coupled to the second non-conductive element and slidable in relation to the bottom plate to move the second non-conductive element and the contact ends of the second plurality of conductive elements relative to the inside surface of the bottom plate.

In Example 13, the subject matter of Example 12 optionally includes a top lever arranged on an outside surface of the top plate and a bottom lever arranged on an outside surface of the bottom plate, wherein the at least one arm coupled to the first non-conductive element includes a first rod and a second rod slidable through the top plate and coupled to the top lever, and wherein the at least one arm coupled to the second non-conductive element includes a third rod and a fourth rod slidable through the bottom plate and coupled to the bottom lever.

In Example 14, the subject matter of Example 13 optionally includes a first non-conductive element including a first beam coupled to the first and second rods and engaging the contact ends of the first plurality of conductive elements, and the second non-conductive element includes a second beam coupled to the third and fourth rods and engaging the contact ends of the second plurality of conductive elements.

In Example 15 the subject matter of one or any combination of Examples 12-14 optionally includes a conductive element includes a spring element to bias the contact end of the conductive element away from the inside surface of the top plate or the inside surface of the bottom plate.

In Example 16 the subject matter of Example 15 optionally includes a top lever arranged on an outside surface of the top plate and including a first lever end coupled to the at least one arm coupled to the first non-conductive element, a second lever end coupled to the outer surface of the top plate by a spring, and a top pivot arranged between the first lever end and the second lever end of the top lever; and a bottom lever arranged on an outside surface of the bottom plate and including a first lever end coupled to the at least one arm coupled to the second non-conductive element, a second lever end coupled to the outer surface of the bottom plate by a spring, and a bottom pivot arranged between the first lever end and the second lever end of the bottom lever, wherein pushing the second lever ends of the top lever and bottom lever toward the top plate and bottom plate causes the first lever ends to raise and pull the contact ends of the conducive elements toward the inside surfaces of the first and second plates, and wherein releasing the second lever ends causes the conductive elements to move away from the inside surfaces of the top plate and bottom plate.

Example 17 includes subject matter (such as method of making a connector for an electronic assembly) comprising forming a first plurality of electrical contact pads on a top surface of a linear edge connector substrate and a second plurality of electrical contact pads on a bottom surface of the linear edge connector substrate, the linear edge connector substrate for insertion into a cable connector configured for electronic fabric interconnection; and adding conductive material to the electrical contact pads until a height defined by the linear edge connector substrate, the electrical contact pads of the top surface and the electrical contact pads of the bottom surface matches a height between top edge connectors and bottom edge connectors of the cable connector.

In Example 18, the subject matter of Example 17 optionally includes adding the conductive material to the electrical contact pads by depositing copper onto the electrical contact pads.

Example 19 can include subject matter (such as an electronic assembly), or can optionally be combined with one or any combination of Examples 1-18 to include such subject matter, comprising a linear edge connector substrate, wherein the linear edge connector substrate has a first thickness; and a plurality of electrical contact pads arranged on a top surface and bottom surface of the linear edge connector substrate, wherein the contacts pads include conductive material such that the combined thickness of the linear edge connector substrate and the contact pads is a second thickness specified for connection to a cable connector configured for electronic fabric interconnection.

In Example 20, the subject matter of Example 19 optionally includes the first thickness corresponds to a specified substrate layer count, and the second thickness corresponds to a second specified substrate layer count.

Example 21 can include subject matter (such as an electronic assembly), or can optionally be combined with one or any combination of Examples 1-20 to include such subject matter, comprising a cable for electronic fabric interconnection; a cable connector configured for connection to an edge connector substrate, the cable connector including: a first connector body portion including a first plurality of electrical contacts arranged to contact electrical contacts of a first surface of an edge connector substrate; a second connector body portion separate from the first connector body portion and including a second plurality of electrical contacts arranged to oppose the first plurality of electrical connectors of the first connector body portion and to contact a electrical contacts of a second surface of the edge connector substrate, wherein the first plurality of electrical contacts and the second plurality of electrical contacts are electrically coupled to the cable; and a joining mechanism configured to join the first connector body portion and the second connector body portion together and to apply a bias force to the edge connector substrate when the edge connector substrate is arranged between the first connector body portion and the second connector body portion.

In Example 22, the subject matter of Example 21 optionally includes a joining mechanism including a housing arranged around the first connector body portion and the second connector body portion, wherein the housing includes an opening to receive the edge connector substrate; and one or more springs arranged internal to the housing to apply the bias force to one or both of the first connector body portion and the second connector body portion.

In Example 23, the subject matter of one or both of Examples 21 and 22 optionally includes a joining mechanism including: a lever arm including a pivot point, wherein the lever arm turns about the pivot point; a cam arranged at the pivot point of the lever arm and rotatable by the lever arm; and a spring arranged between the cam and the second connector body portion, wherein the lever arm in a closed position compresses the spring with the cam to apply the bias force to the second connector body portion.

In Example 24, the subject matter of one or any combination of Examples 21-23 optionally includes one or more springs arranged between the first connector body portion and the second connector body portion to bias the first and second connector body portions apart, wherein the joining mechanism includes one or more screws and threaded screw holes.

In Example 25, the subject matter of one or any combination of Examples 21-24 optionally includes including one or more springs arranged between the first connector body portion and the second connector body portion to bias the first and second connector body portions apart and a joining mechanism including: a housing, including a first housing portion to contact the first connector body portion and a second movable housing portion to contact the second connector body portion; a lever arm including a pivot point connected to the first housing portion, wherein the lever arm turns about the pivot point to contact the second movable housing portion in a closed position and apply the bias force to the second movable housing portion and the second connector body portion; and a locking mechanism to hold the lever arm in the closed position.

In Example 26 the subject matter of one or any combination of Examples 21-25 optionally includes a second connector body portion includes multiple pegs and the first connector body portion includes multiple slots to receive the multiple pegs, wherein a joining mechanism optionally including one or more springs, arranged between the first connector body portion and the second connector body portion, and configured to draw the first connector body portion and the second connector body portion together to provide the bias force, wherein the first and second connector body portions include wings extending outward from each side of the first and second connector body portions, wherein the electronic assembly further includes a bolster slidable from a first position that separates the wings to separate the first and second body portions to a second position that allows the first and second body portions to draw together.

In Example 27, the subject matter of one or any combination of Examples 21-26 optionally includes a lever configured to contact the second connector body portion at opposite edges of a top surface of the second connector body portion, wherein the first connector body portion includes sidewalls, wherein the sidewalls each include a lever pivot point and a locking mechanism, wherein the lever is rotatable about each pivot point to engage each locking mechanism, and wherein the lever applies the bias force to the second connector body when the lever engages the locking mechanism.

These several Examples can be combined using any permutation or combination. The Abstract is provided to comply with 37 C.F.R. Section 1.72(b) requiring an abstract that will allow the reader to ascertain the nature and gist of the technical disclosure. It is submitted with the understanding that it will not be used to limit or interpret the scope or meaning of the claims. The following claims are hereby incorporated into the detailed description, with each claim standing on its own as a separate embodiment.

What is claimed is:

1. An apparatus comprising: a cable connector including:

a first connector body portion including a first plurality of electrical contacts arranged to contact electrical contacts of a first surface of an edge connector substrate;

a second connector body portion separate front the first connector body portion and including a second plurality of electrical contacts arranged to oppose the first plurality of electrical contacts of the first connector body portion and to contact electrical contacts of a second surface of the edge connector substrate, wherein the first plurality of electrical contacts and the second plurality of electrical contacts are electrically coupled to one or more cables; and a joining mechanism including one or more springs arranged between the first connector body portion and the second connector body portion, and wherein the one or more springs are configured to draw the first connector body portion and the second connector body portion together to apply a bias force to the edge connector substrate when the edge connector substrate is arranged between the first connector body portion and the second connector body portion.

2. The apparatus of claim 1, wherein the first connector body portion includes multiple pegs and the second connector body portion includes multiple slots to receive the multiple pegs.

3. The apparatus of claim 2, including a bolster, wherein the first and second connector body portions include wings extending outward from each side of the first and second connector body portions, and wherein the first and second connector body portions are slidable relative to the bolster from a first position that separates the wings to separate the first and second body portions to a second position that allows the first and second body portions to draw together.

4. The apparatus of claim 2, wherein at least one of the first connector body portion and the second connector body portion includes multiple tabs to engage matching notches of the edge connector substrate when the edge connector substrate is inserted between the first connector body portion and the second connector body portion.

5. An electronic assembly comprising:

a cable for electronic fabric interconnection;

a cable connector configured for connection to an edge connector substrate, the cable connector including:

a first connector body portion including a first plurality of electrical contacts arranged to contact electrical contacts of a first surface of an edge connector substrate;

a second connector body portion separate from the first connector body portion and including a second plurality of electrical contacts arranged to oppose the first plurality of electrical connectors of the first connector body portion and to contact a electrical contacts of a second surface of the edge connector substrate, wherein the first plurality of electrical contacts and the second plurality of electrical contacts are electrically coupled to the cable; and a joining mechanism including one or more springs arranged between the first connector body portion and the second connector body portion, and wherein the one or more springs are configured to draw the first connector body portion and the second connector body portion together to apply a bias force to the edge connector substrate when the edge connector substrate is arranged between the first connector body portion and the second connector body portion.

6. The electronic assembly of claim 5, wherein the second connector body portion includes multiple pegs and the first connector body portion includes multiple slots to receive the multiple pegs, wherein the first and second connector body portions include wings extending outward from each side of the first and second connector body portions, wherein the electronic assembly further includes a bolster slidable from a first position that separates the wings to separate the first and second body portions to a second position that allows the first and second body portions to draw together.

7. The electronic assembly of claim 5, including the edge connector substrate, wherein at least one of the first connector body portion and the second connector body portion includes multiple tabs to engage matching notches of the edge connector substrate when the edge connector substrate is inserted between the first connector body portion and the second connector body portion.

* * * * *